US009532675B2

(12) United States Patent
Perache et al.

(10) Patent No.: US 9,532,675 B2
(45) Date of Patent: Jan. 3, 2017

(54) MOTORIZED CARRIAGE, SCREEN-MOVING ASSEMBLY COMPRISING SUCH A CARRIAGE, SCREENING INSTALLATION AND METHOD FOR OPERATING SUCH AN INSTALLATION

(71) Applicant: SOMFY SAS, Cluses (FR)

(72) Inventors: Jean-Michel Perache, Taninges (FR); Josiane Dunand, Vallorcine (FR); Marc Brechemier, Cran Gevrier (FR)

(73) Assignee: SOMFY SAS, Cluses (FR)

( * ) Notice: Subject to any disclaimer, the term of this patent is extended or adjusted under 35 U.S.C. 154(b) by 20 days.

(21) Appl. No.: 14/381,313

(22) PCT Filed: Feb. 27, 2013

(86) PCT No.: PCT/EP2013/053953
§ 371 (c)(1),
(2) Date: Aug. 27, 2014

(87) PCT Pub. No.: WO2013/127870
PCT Pub. Date: Sep. 6, 2013

(65) Prior Publication Data

US 2015/0041078 A1 Feb. 12, 2015

(30) Foreign Application Priority Data

Feb. 28, 2012 (FR) ..... 12 51802
Sep. 10, 2012 (FR) ..... 12 58465

(51) Int. Cl.
*A47H 5/02* (2006.01)
*A47H 1/04* (2006.01)
*A47H 5/032* (2006.01)

(52) U.S. Cl.
CPC *A47H 5/02* (2013.01); *A47H 1/04* (2013.01); *A47H 5/0325* (2013.01)

(58) Field of Classification Search
CPC ..... A47H 5/02; A47H 5/0325; A47H 1/04; A47H 15/02
(Continued)

(56) References Cited

U.S. PATENT DOCUMENTS 3,797,171 A * 3/1974 Farmer ..... E05F 15/676 160/188
2004/0173117 A1* 9/2004 Galpin ..... B61C 13/04 105/148
(Continued)

FOREIGN PATENT DOCUMENTS

CN 2080360 7/1991
CN 2177415 9/1994
(Continued)

OTHER PUBLICATIONS

International Search Report, dated Oct. 31, 2013, from corresponding PCT application.
(Continued)

*Primary Examiner* — Blair M Johnson
(74) *Attorney, Agent, or Firm* — Young & Thompson

(57) ABSTRACT

This motorized carriage for opening/closing a curtain is able to move along a rail thanks to a friction wheel driven by an electric motor and pivot mounted in a casing containing this electric motor. The casing is provided with at least two members for suspending it from the rail or from the rod, which include a support and/or a base element and at least one pivoting roller. The casing is equipped with at least one housing for partially accommodating and reversibly immobilizing each suspension member, so that the pivoting rollers or the shoes of the suspension members are mounted removably on the casing. The support is mounted, removably and via a rotational movement (F4), in the housing. Elements allow the support to be immobilized about its axis of
(Continued)

Figure 1:
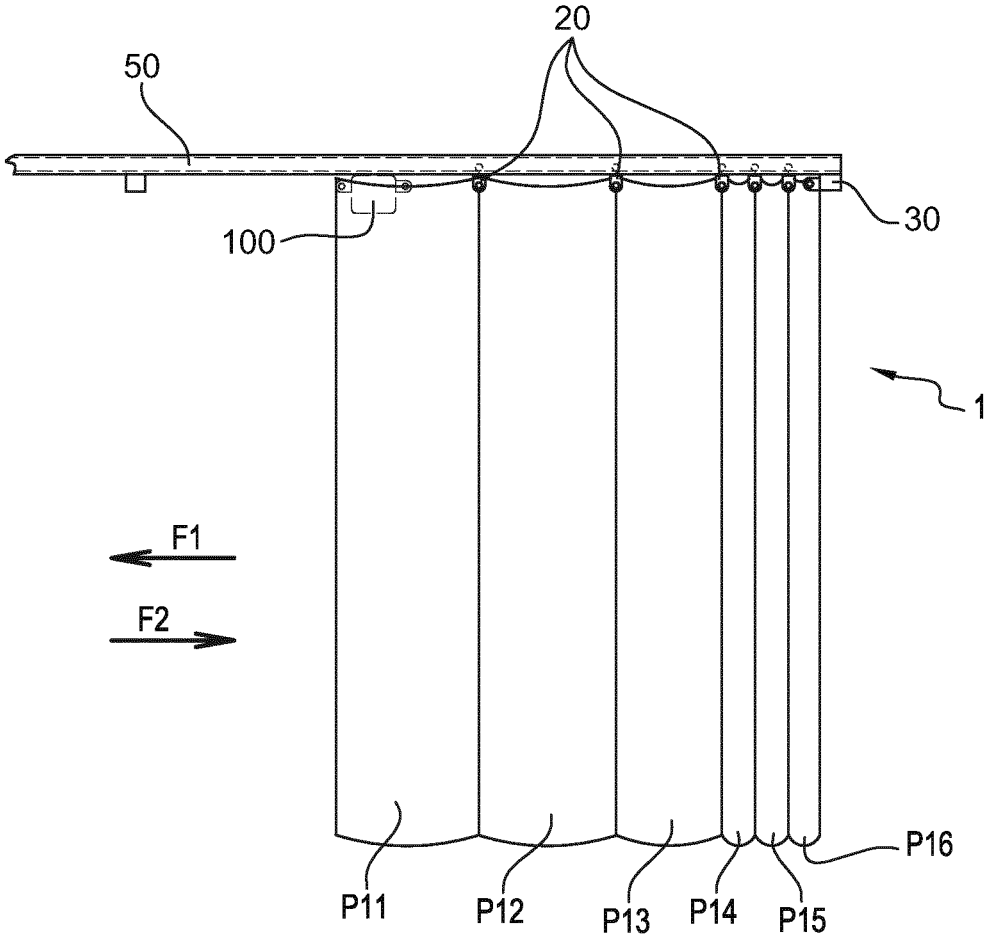

rotation. The movement assembly (E) includes a casing and at least two sets of two suspension members.

20 Claims, 10 Drawing Sheets

(58) Field of Classification Search
USPC ..... 160/331; 16/87.4 R, 96 D, 87.2
See application file for complete search history.

(56) References Cited

U.S. PATENT DOCUMENTS

| | | | | |
|---|---|---|---|---|
| 2005/0172563 | A1* | 8/2005 | Komoda | A47H 5/0325 49/358 |
| 2013/0160955 | A1 | 6/2013 | Cavarec et al. | |
| 2015/0041078 | A1* | 2/2015 | Perache | A47H 1/04 160/331 |

FOREIGN PATENT DOCUMENTS

| | | | |
|---|---|---|---|
| CN | 1101247 | | 4/1995 |
| CN | 102743091 | | 10/2012 |
| DE | 10 57 756 | B | 5/1959 |
| DE | 24 36 736 | A1 | 2/1975 |
| DE | 24 36 753 | A1 | 3/1975 |
| FR | 2 962 317 | A1 | 1/2012 |
| JP | 09 327373 | A | 12/1997 |
| JP | 11-113733 | | 4/1999 |
| JP | 2005 095364 | A | 4/2005 |
| WO | 2012/004530 | A1 | 1/2012 |

OTHER PUBLICATIONS

FR Search Report, dated Oct. 17, 2012, from corresponding FR application.

* cited by examiner

MOTORIZED CARRIAGE, SCREEN-MOVING ASSEMBLY COMPRISING SUCH A CARRIAGE, SCREENING INSTALLATION AND METHOD FOR OPERATING SUCH AN INSTALLATION

The present invention relates to a motorized carriage for opening/closing a curtain, that carriage being able to move along a rail or a rod. The invention also relates to an assembly for moving a curtain that comprises a carriage of the aforementioned type, as well as an installation for screening an opening that comprises such a carriage, inter alia. The invention lastly relates to a method for operating such an installation.

Different devices exist that make it possible to maneuver the opening of a curtain for screening an opening such as a window. One solution consists of motorizing the movement of a head carriage on which one end of the curtain is fixed. This head carriage comprises guide wheels, generally at least two pairs of wheels, that roll on rolling tracks formed along a rail fastened near the upper edge of an opening to be screened.

It is known from JP-A-2005-095364 to incorporate a friction wheel rotated by an electric motor into a carriage. The contact force between the friction wheel and a rolling surface on which it moves is adjustable, statically, owing to a pressing means. It is also known from DE-A-24 36 753 to generate a contact force between a friction wheel and a rail, taking the direction of movement into account.

It is also known from WO-A-2012/004530 to use a pressing means to vary the contact force between the friction wheel and the rolling surface of the rail, based on a resistive force that depends on the evolution of the load pulled or pushed by the carriage during its movement.

These known materials are based on a good match between the carriage and the rail or the rod along which it slides. However, a large number of rails and rods exist on the market with different dimensions and profiles. This variety of commercially available rails and rods makes it necessary to provide specific carriages adapted to each of those rails or rods, which is complicated and expensive, in terms of manufacturing and in terms of spare part management.

It is also known from JP-A-9-327373 to provide interchangeable rollers on a motorized carriage. These rollers are mounted on supports that normally remain in place on the carriage, which makes a roller loading operation both lengthy and delicate. Furthermore, the supports are supported on lugs protruding on the front and back of the carriage, which increases the bulk of the carriage in a front-to-back direction.

The invention more particularly aims to resolve these drawbacks by proposing a new motorized carriage that can be easily adapted to different geometries of support rails.

To that end, the invention relates to a motorized carriage for opening/closing a curtain, said carriage being able to move along a rail or a rod owing to a friction wheel driven by an electric motor and pivot-mounted in a casing that contains the electric motor, said casing being provided with at least two members for suspending it from the rail or the rod and which comprise a support and/or a base element, as well as at least one roller pivoting around an axis, or skate. According to the invention, the casing is equipped with a housing for partially receiving and reversibly immobilizing each suspension member, such that the pivoting rollers or the skates of the suspension members are removably mounted on the casing.

Owing to the invention, the removable mounting of the suspension members on the casing makes it possible to mount the associated rollers or skates on the usage site of the carriage, when the rail or the rod with which the carriage must cooperate has been identified. This removable mounting makes it possible, if applicable, to change these parts of the suspension members to adapt them to the geometry of the rail or the rod. Since the suspension members are mounted in a housing formed in the casing, they may be situated in the immediate vicinity of the friction wheel, which enables precise calibration of the friction force between that wheel and the rail or the rod. Furthermore, the mounting mode of the supports of the suspension members on the casing makes it possible to give the carriage a satisfactory compactness in a front-to-back direction, as well as compactness upon passing over any curved areas of the rail or the rod. According to advantageous, but optional aspects of the invention, such a carriage may incorporate one or more of the following features considered in any technically allowable combination:

- The support of each suspension member is mounted, removably and through a rotational movement around an axis of rotation, in or across from the housing formed in the casing and the carriage comprises immobilizing means, for immobilizing, in rotation around the axis of rotation, of the support or of a retaining member of the support. Owing to this aspect of the invention, since the supports of the suspension members are mounted removably, they can be changed in one operation, with the rollers or skates that they support, which is quick and limits risks of operator error. The immobilizing means make it possible to block the support or a retaining member in rotation relative to the casing, which makes it possible to fix the orientation of the pivot axis of the rollers or the longitudinal axis of the skates with respect to the casing. This improves the stability of the carriage, including after a significant number of movements along the rail or the rod. In particular, these blocking means make it possible to guarantee that rollers equipping the support are globally aligned with a longitudinal axis of the casing of the carriage, which limits the risks of blockage of those rollers in the curved areas of the rail or of the rod.
- The support is immobilized in the corresponding housing by a bayonet mechanism.
- When it is placed in the corresponding housing, the support is subject to the action of an elastic return means toward a locked position.
- The support bears at least one slug and the housing of the casing comprises at least one groove for receiving the slug during the rotational movement, while the means for immobilizing the rotation of the support comprise a seat in which the groove emerges and the elastic load means for loading the slug toward and in the seat.
- Each suspension member is fastened on a base element mounted in the housing while the support is mounted by screwing itself or a retaining member on the base element.
- The elements immobilizing the rotation of the support comprise a member blocking the screwing/unscrewing of the support or the retaining element relative to the base element.
- The base element is movable in rotation, within the housing, around an axis perpendicular to the axis of rotation of the support or the retaining member during screwing thereof.

The carriage comprises means for adjusting a vertical distance between an axis of rotation of a roller pivotably mounted on the support on the one hand, and an axis of rotation of the friction wheel on the other hand.

The adjusting means comprise a screw for adjusting the position of at least one slug belonging to the bayonet mechanism relative to the support.

The adjusting means are formed by the connecting means screwed between the support and the base element.

The carriage comprises means for adjusting the contact force between the friction wheel and the rail or the rod.

The support is provided with at least one slug designed to cooperate with a groove formed in the corresponding housing of the casing, that slug is mounted with the possibility of movement relative to a part of the support on which the roller is mounted, whereas the relative movement between the slug and the part of the support is possible against an elastic force exerted by a return means, and means make it possible to adjust the intensity of the elastic force.

Each suspension member is equipped with at least one roller pivoting around an axis whereas a distance, measured parallel to a front-to-back axis of the carriage, between the axis of rotation on the one hand, and an axis of rotation of the friction wheel on the other hand, is less than 2 times the diameter of that wheel, preferably 1.5 times the diameter.

The invention also makes it possible to take into account that, in particular for esthetic reasons, it may be desirable to suspend the curtain from a rod with a solid section, for example a rod with a solid circular section. In that case, the materials known from JP-A-2005-095364, DE-A-24 36 736, WO-A-2012/004530 and JP-A-9-327373 are not suitable. The invention proposes an alternative solution to those documents, adapted to a screening installation comprising a rod with a solid section.

More specifically, according to a second aspect, the invention relates to a motorized carriage for opening/closing the curtain, that carriage being capable of moving along a rod owing to a friction wheel driven by an electric motor and pivot-mounted in a casing that contains the motor, said casing being provided with at least two members for suspension from the rod. This carriage characterized in that each suspension member comprises an annular element provided to surround the rod and which includes a rotating roller, which in turn is provided to roll against the rod, whereas the rotating roller is positioned opposite the casing relative to a central axis of the annular element.

Owing to this aspect of the invention, the annular element makes it possible to position the rotating roller of each suspension member on the top of the rod, which then constitutes an upper rolling area for the roller.

According to other advantageous, but optional aspects of the invention, such a carriage may incorporate one or more of the following features, in any technically allowable combination:

Each annular element comprises two plates designed to be positioned on either side of the rod and between which the roller is pivot-mounted.

Each plate is articulated on a support of the suspension member, around an axis perpendicular to an axis of rotation of the roller and globally parallel to a front-to-back direction of the carriage.

Each plate has a warped shape, with its concave side turned toward the other plate of the same suspension member.

The carriage comprises a member for attaching the curtain, that member being mounted on the two suspension members.

The attaching member is mounted with the possibility of relative movement on at least one of the suspension members.

The attaching member has an elongated shape, extends globally in a front-to-back direction of the carriage and comprises, at each of its ends, means for attaching the curtain.

The invention also relates to an assembly for moving a curtain along a rail or a rod, said assembly comprising:

a casing containing an electric motor and on which a friction wheel is pivot-mounted, said casing being equipped with means for attaching the curtain, a first set of two members for suspending the casing from the rail or the rod, each member of the first set comprising at least one element rolling or sliding on a track of the rail or the rod and each member of the first set being capable of being movably mounted on the casing, with a distance between the axis of rotation of the friction wheel and a landmark of the rolling or sliding member, measured perpendicular to the track, equal to a first value for each member of that first set, and at least one second set of two members for suspending the casing from the rail or the rod, each member of that second set comprising at least one element rolling or sliding on the track of the rail or rod and each member of that second set being capable of being removably mounted on the casing, in place of a member from the first set, whereas the geometry of the rolling or sliding element of the members of the second set is different from the geometry of the rolling or sliding element of the members of the first set or whereas the distance between the axis of rotation of the friction wheel and the landmark of the rolling or sliding element, measured parallel to the track, is equal, for each member of the second set, to a value different from the first value.

The invention further relates to an installation for screening an opening comprising a rail or a rod, a motorized carriage and a curtain attached to that motorized carriage, said installation being characterized in that the carriage is as described above or belongs to a moving assembly as mentioned above.

In the event each suspension member of the carriage comprises an annular element provided to surround the rod and which includes a rotating roller, as considered above, it may be provided that the carriage rests, by the rotating rollers of its suspension members, on the upper rolling zone of the rod.

In that case, the axis of rotation of each rotating roller is advantageously horizontal and perpendicular to a longitudinal axis of the rod.

Lastly, the invention relates to a method for operating an installation as mentioned above, said method comprising the following successive steps:

a) placing the curtain on the rod by engaging that rod in the rings belonging or secured to the curtain, b) placing the carriage on the rod, between two of the rings, by inserting the rod into the annular element of each suspension member through a temporary opening formed in one such element, c) closing the temporary opening of each annular element, d) bringing the rotating roller of each annular element to bear against the upper rolling zone of the rod, and e) attaching the curtain to the carriage.

Steps b) to e) are all after step a) and may be done in an order different from that described above.

Figure 2:
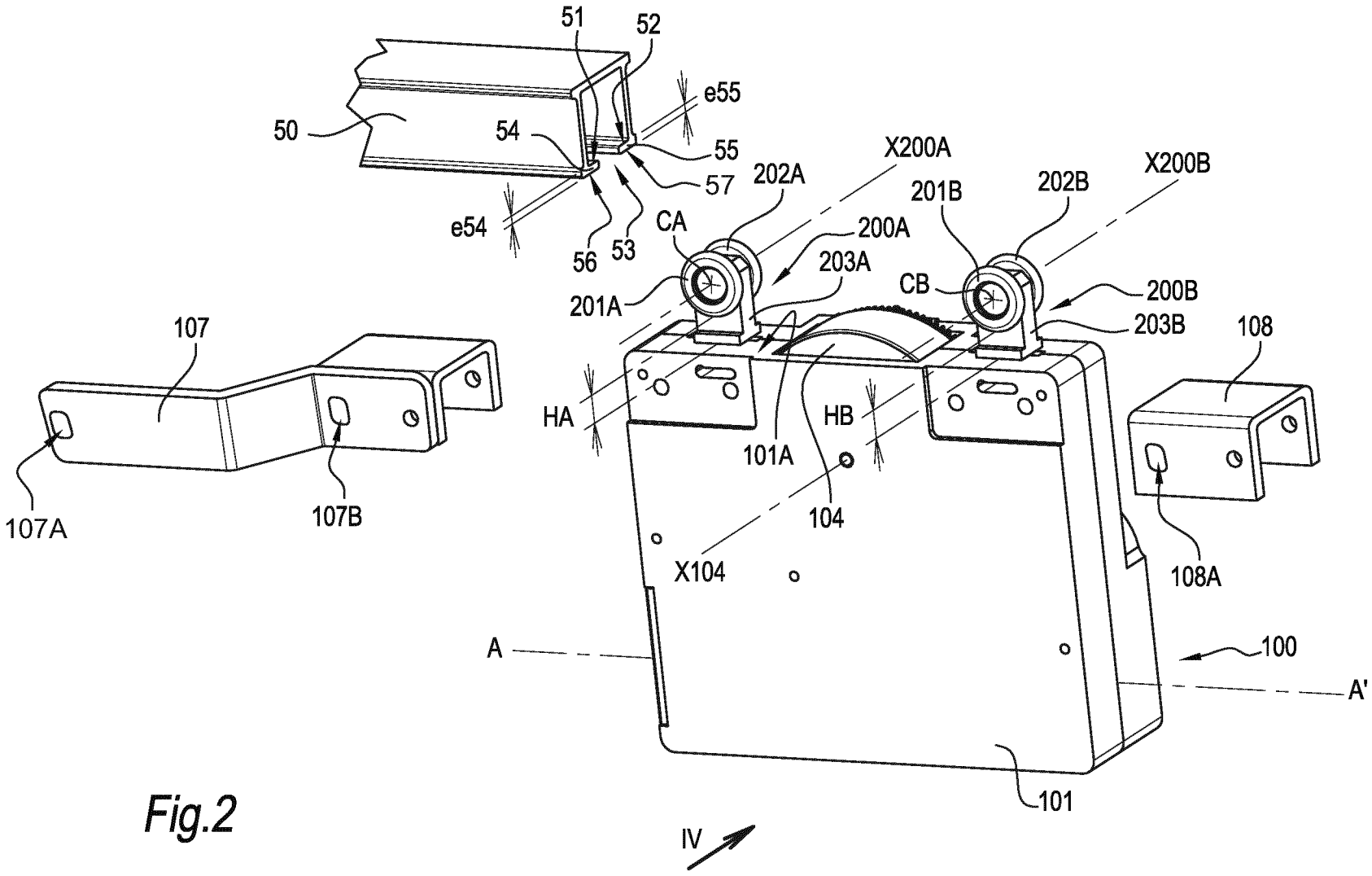
Figure 3:
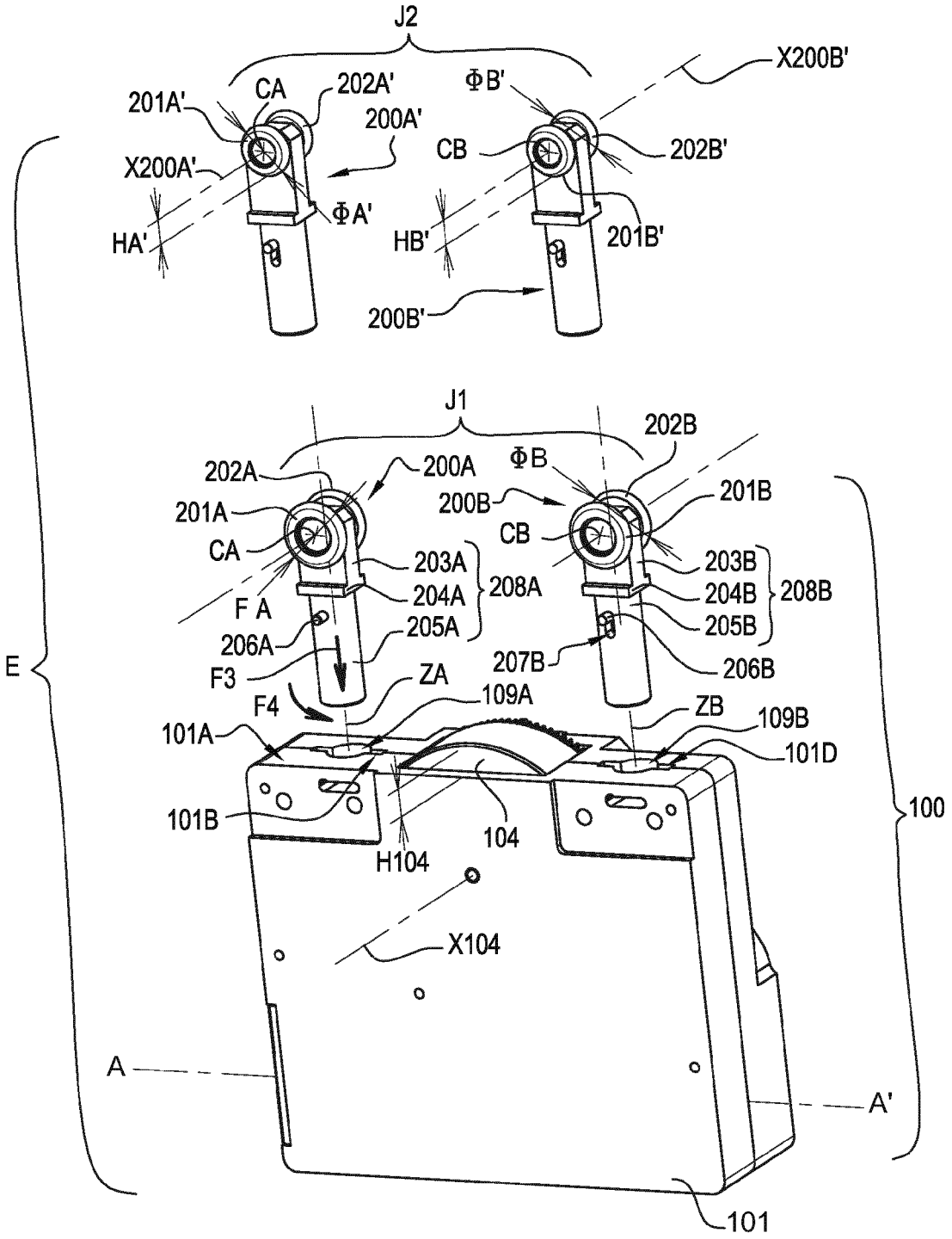
Figure 4:
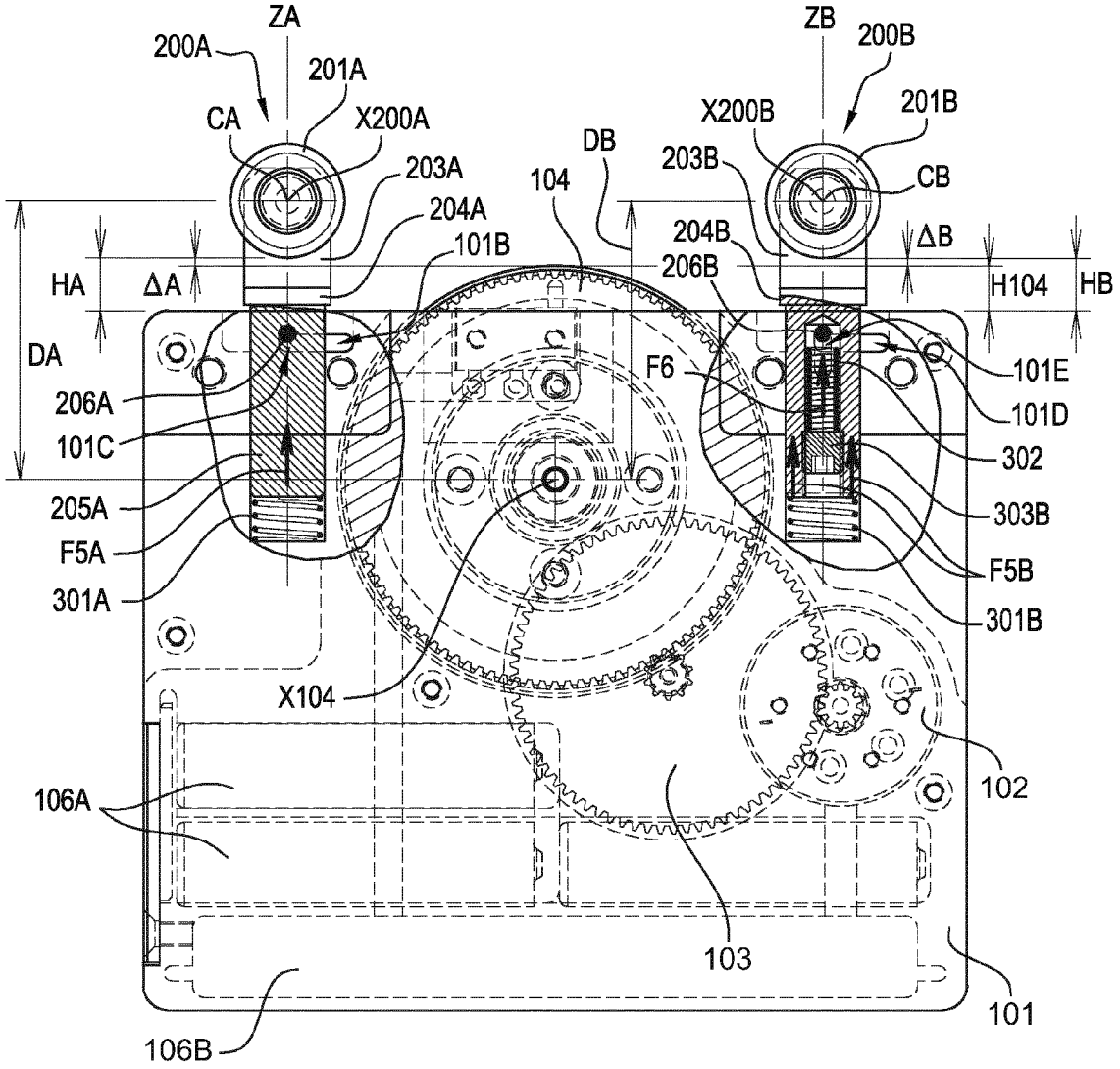
Figure 5:
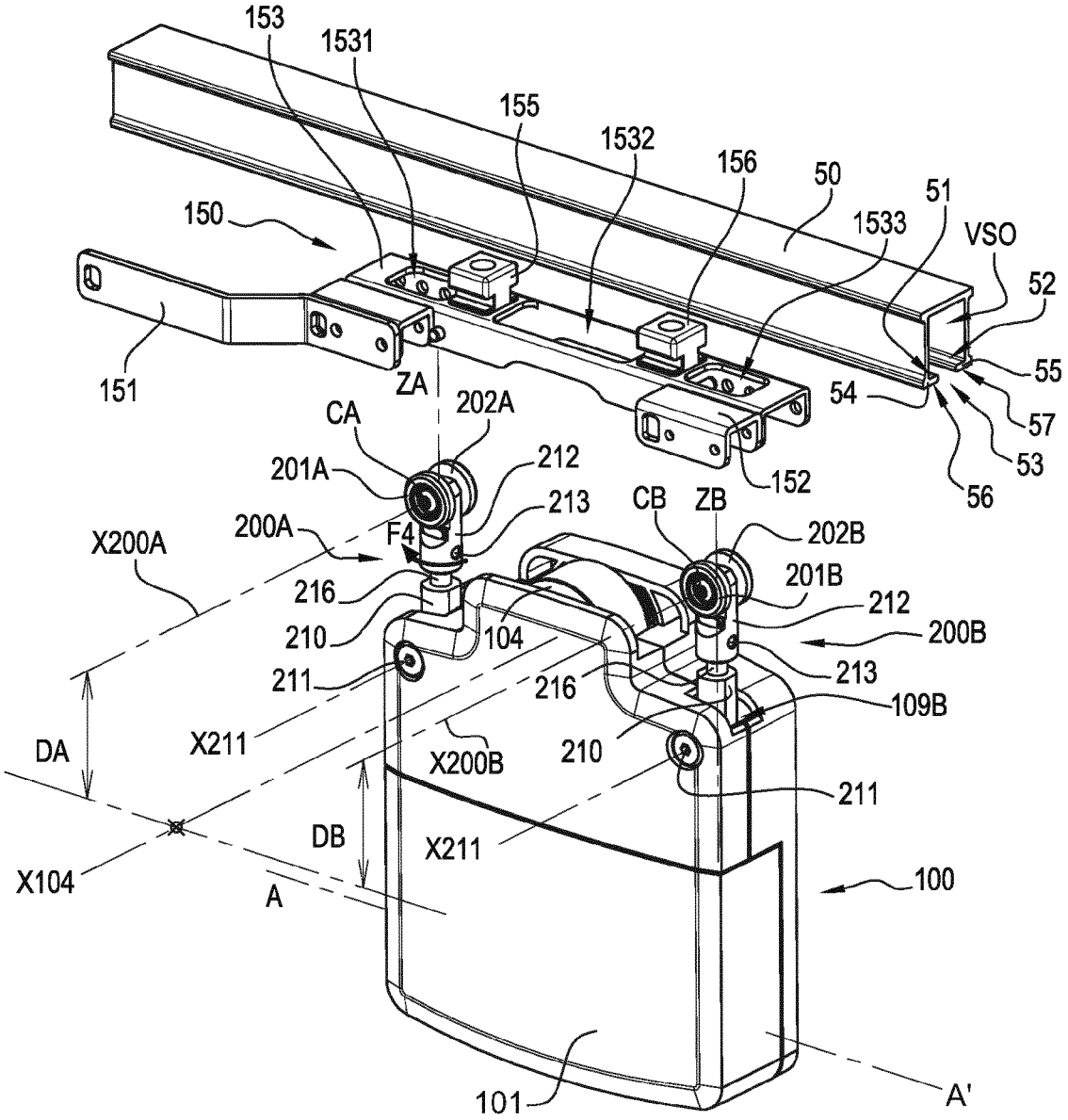
Figure 6:
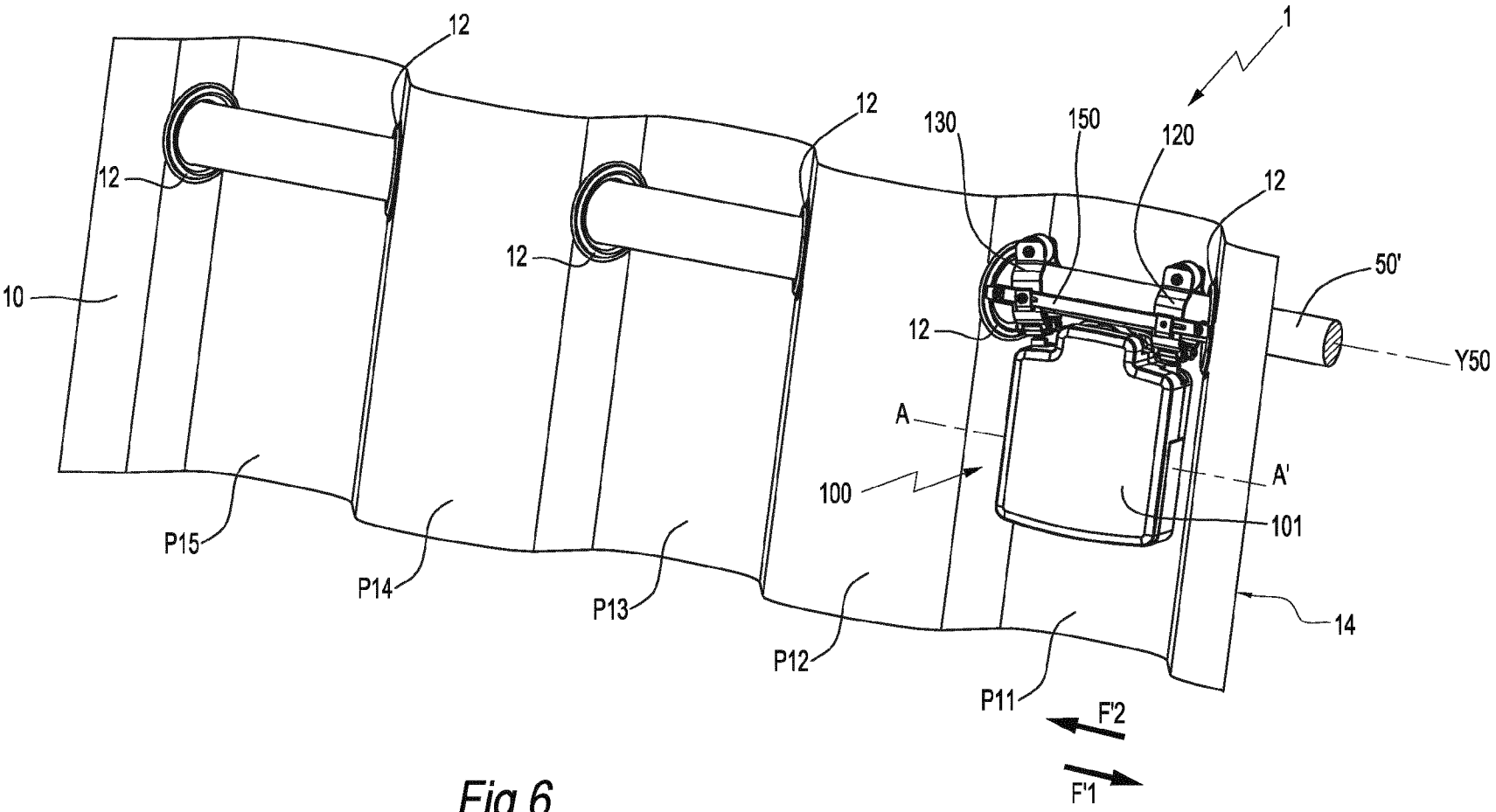
Figure 7:
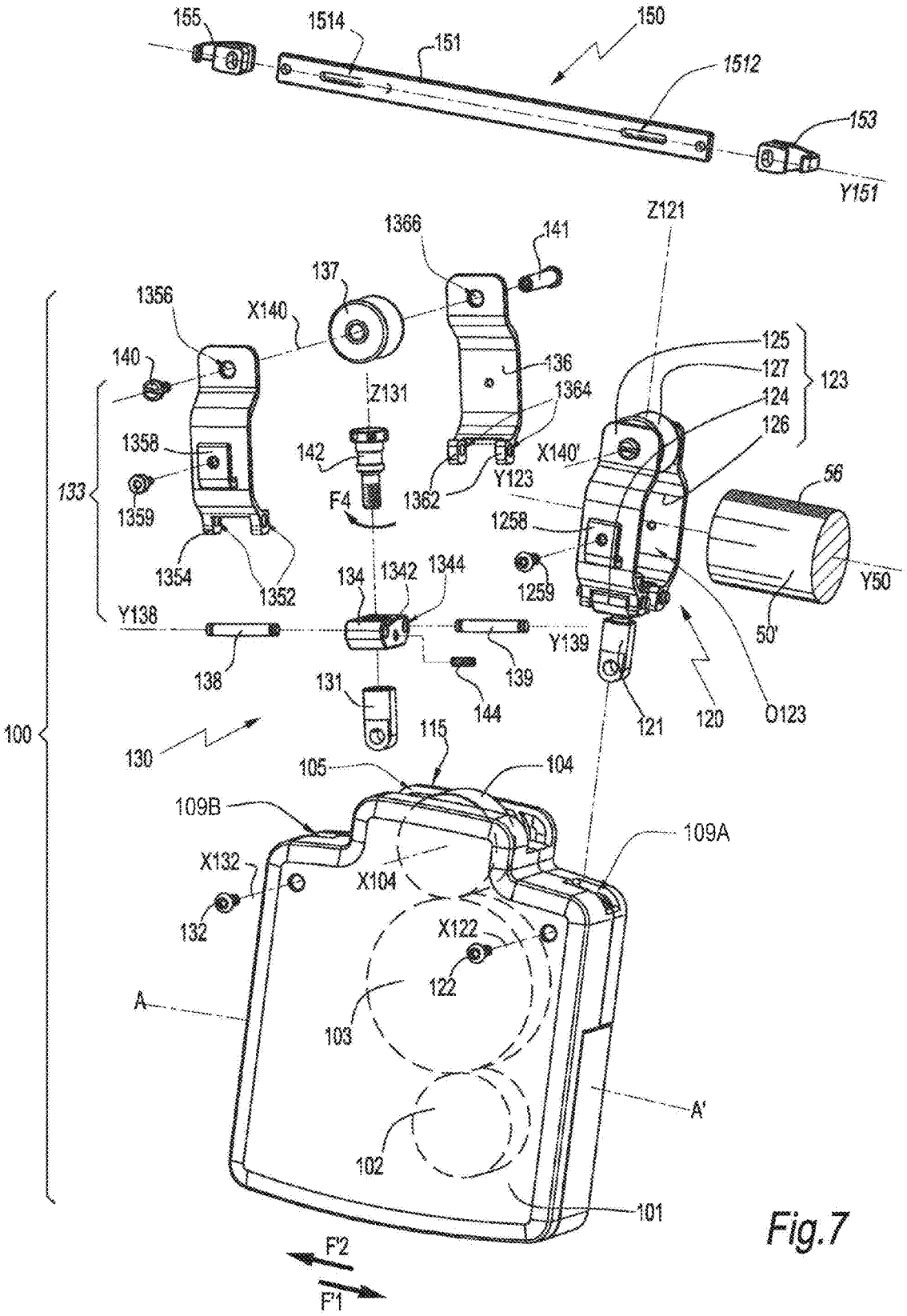
Figure 8:
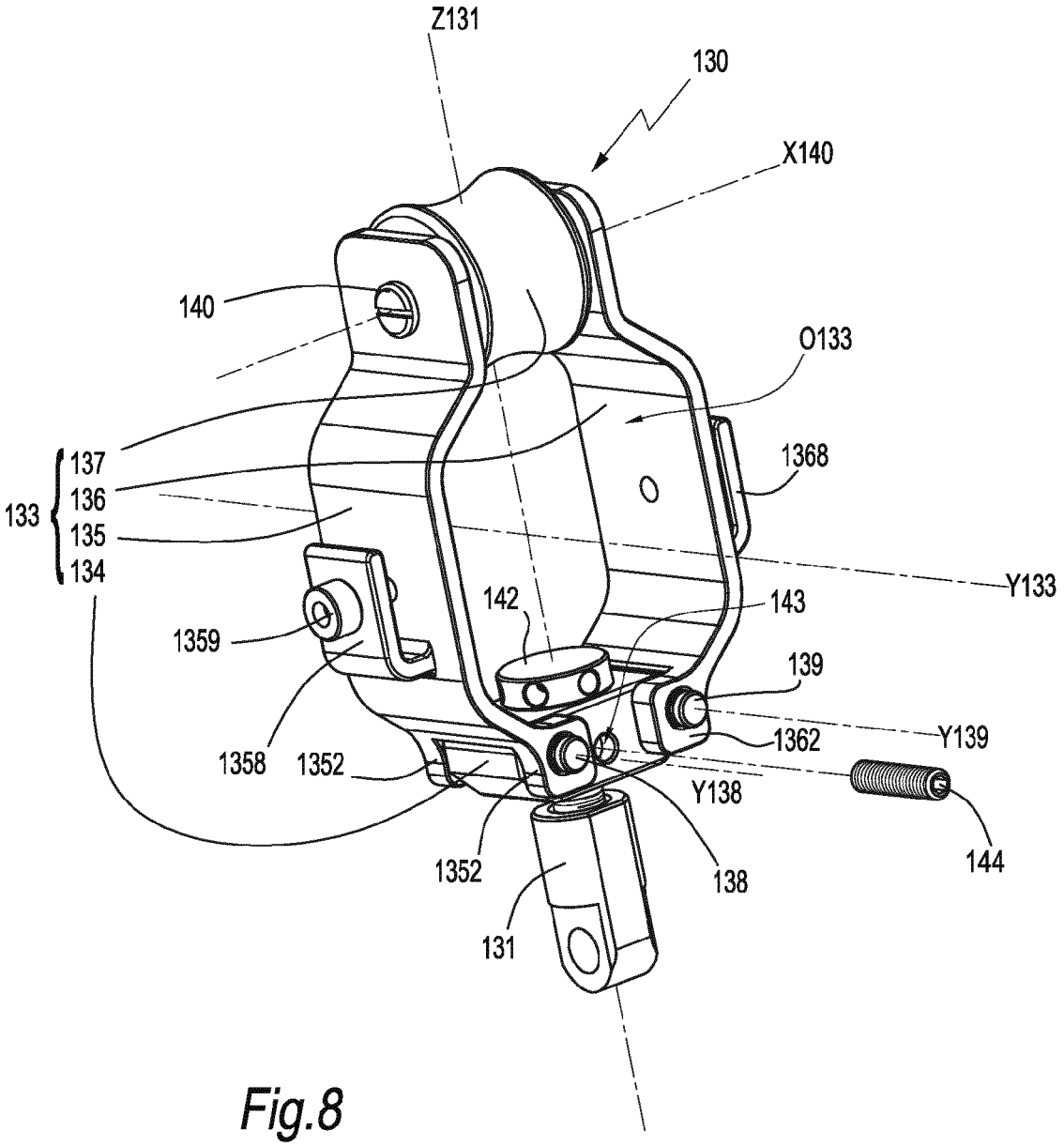
Figure 9:
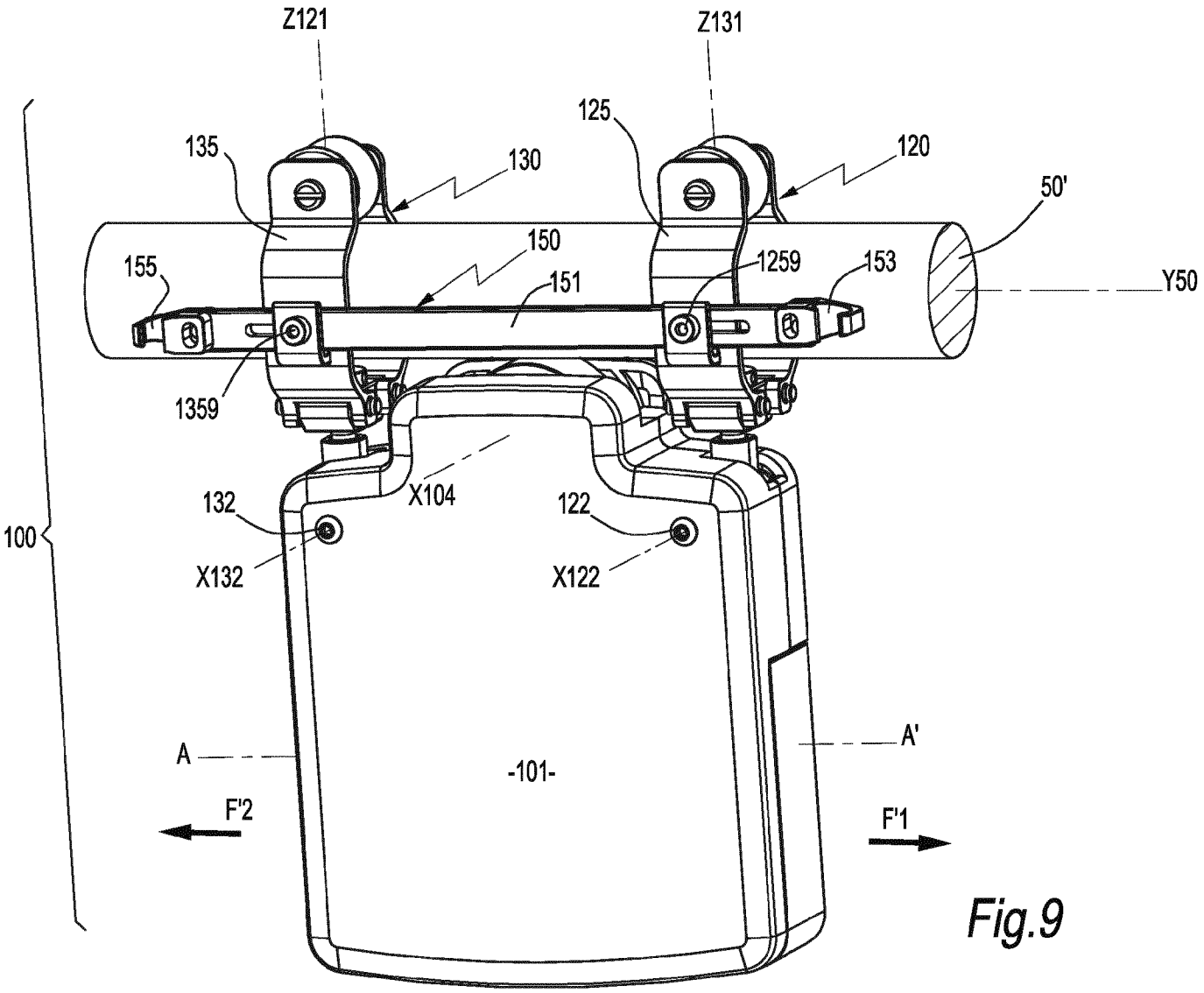
Figure 10:
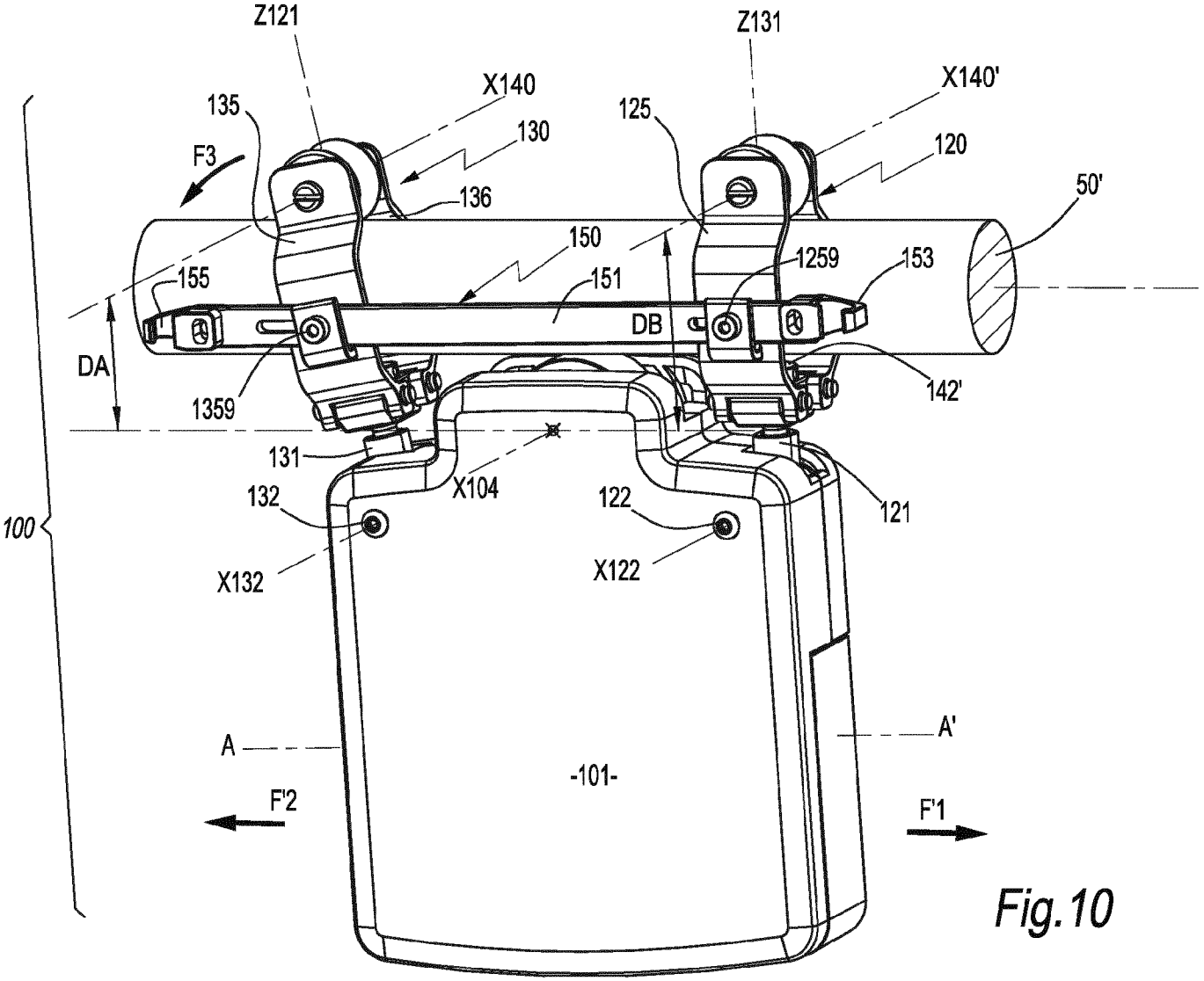

The invention will be well understood, and other advantages thereof will appear more clearly, in light of the following description of three embodiments of a carriage, a moving assembly and an installation according to its principle, provided solely as an example and done in reference to the appended drawings, in which:

FIG. 1 is a diagrammatic block illustration of a curtain installation incorporating a motorized carriage according to the invention, FIG. 2 is an exploded partial perspective view of the carriage and the rail of the installation of FIG. 1, FIG. 3 is an exploded perspective view of the carriage shown in FIG. 2, without the attachment tabs for the curtain, within an assembly for moving a screen according to the invention, FIG. 4 is a side view of a casing of the carriage in the direction of arrow IV in FIG. 2, with partial cutaways, FIG. 5 is a view similar to FIG. 2 for a carriage and an installation according to a second embodiment of the invention, FIG. 6 is a partial diagrammatic perspective illustration of another curtain installation according to the invention and incorporating a motorized carriage according to a third embodiment of the invention, FIG. 7 is an exploded perspective view of the motorized carriage and the rod of the installation of FIG. 6, FIG. 8 is a perspective view, from another angle, of a suspension member of the carriage of FIG. 7, FIG. 9 is a perspective view of the carriage of FIG. 7 in place on the rod in the first usage configuration, the curtain being omitted for clarity of the drawing, and FIG. 10 is a view similar to FIG. 9 when the carriage is in a second usage configuration.

FIG. 1 illustrates a system for motorizing a curtain 10 within an installation 1 for screening a window (not shown). The curtain, which forms a covering screen, is suspended from carriages of two types, 20 and 100, owing to hooks (not shown). Each carriage is equipped with guide wheels rolling on rolling tracks arranged along a rail 50 fastened near the upper edge of the window. Thus, the curtain 10 can move along the rail 50. At one of its upper ends, the curtain 10 is attached to a stop 30 fastened to the rail. At its other upper end, the curtain 10 is attached to a motorized head carriage 100, the structure of which is outlined in FIG. 2 and following. The curtain 10 is made up of fabric panels P11 to P16 corresponding to the fabric surface hanging between two support carriages 20 or between the carriage 100 and the closest support carriage 20.

The curtain 10 is closed by moving the curtain to the left in FIG. 1, in the direction of arrow F1. It is opened by moving it to the right, in the direction of arrow F2.

In the present description, the words "top" and "bottom", "upper" and "lower" are used in reference to an operating configuration of the installation of FIG. 1. The words "front" and "rear" are used relative to the direction of movement of the curtain 10 during closing. Thus, a "front" part is situated on the left in FIG. 1, relative to a "rear" part.

As more particularly shown by FIGS. 2 to 4, the carriage 100 comprises a casing 101 made from a plastic material inside which are housed an electric motor 102, a reducing gear 103 and a friction wheel 104 that protrudes from the casing 101 through an opening 105 formed in a casing and the articulation axis of which relative to the housing 101 has been denoted X104. A set of batteries 106A and an electronic board 106B are housed in the casing 101 to power and control the motor 102.

The casing 101 is equipped with a front tab 107 and a rear tab 108 for attaching the moving upper end of the curtain 10. To that end, that end is equipped with hooks (not shown) that are engaged in openings 107A, 107B and 108A respectively formed in the tabs 107 and 108. The tabs 107 and 108 are mounted using any appropriate means, for example by screwing or riveting, on the casing 101, in particular on a front or rear face of the casing.

The casing 101 is suspended relative to the rail 50 using two suspension members 200A and 200B that are each equipped with two rollers 201A, 202A; 201B, 202B, respectively. These rollers are provided to roll on two tracks 51 and 52, respectively, provided inside the rail 50, on either side of a longitudinal slot 53 for the passage of two tabs 203A and 203B on which the rollers 201A and 202A, 201B and 202B, are pivot-mounted around axes X200A and X200B, respectively, which pass through the centers of the rollers that constitute landmarks of those rollers and are aligned on those axes. CA and CB respectively denote the centers of the rollers 201A and 201B.

Each tab 203A and 203B is equipped with a base plate 204A, 204B, respectively, bearing on the upper surface 101A of the casing 101.

H104 denotes the height over which the friction wheel protrudes upward relative to the surface 101A.

HA denotes the height between the lower edge of the rollers 201A and 202A and the surface 101A. Likewise, HB denotes the height between the lower edge of the rollers 201B and 202B and the surface 101A. In the example, the heights HA and HB are equal.

The difference between the heights HA and H104, HB and H104, respectively, are denoted ΔA and ΔB.

Additionally, DA denotes the vertical distance, measured perpendicular to the tracks 51 and 52, between the axes X200A and X104. Likewise, DB denotes the vertical distance between the axes X200B and 104. In the example, these vertical distances are equal. The distance DA is equal to the vertical distance between the center CA and the axis X104. The distance DB is equal to the vertical distance between the center CB and the axis X104.

The height differences ΔA and ΔB define the passage volume for two wings 54 and 55 of the rail 50, the upper surfaces of which respectively constitute the tracks 51 and 52. The lower surfaces 56 and 57 of the wings 54 and 55 together form a rolling surface of the wheel 104. By construction, it is necessary for the height differences ΔA and ΔB to be greater than the vertical thicknesses e54 and e55 of the wings 54 and 55.

These vertical thicknesses can vary from one rail 50 to another commercially available rail. In order to adapt the suspension members to different vertical thicknesses e54 and e55, the distances HA and HB, therefore the distances DA and DB, are adjustable, as explained below. It is, however, possible that this adjustment may not be sufficient, either because the differences between the vertical thicknesses of the available rails are significant, or because the inner volume of the rail itself requires another roller size (diameter, separation or thickness of the rollers in particular).

That is why the members 200A and 200B are mounted removably on the casing 101, so that they can be adapted to the geometry of the rail along which the carriage 100 must travel.

More specifically, as shown in FIG. 3, the member 200A comprises a stem 205A that forms a single piece with the tab 203A and the base plate 204A and is equipped with two slugs, only one of which is visible in the figures with reference 206A. The slug is provided to be engaged in a groove 101B formed in the casing 101 and that emerges in a seat 101C belonging to a bayonet locking system. Each of the slugs 206A and equivalent members is rigidly fastened on the stem 205A, preferably in a single piece therewith.

Likewise, the member 200B comprises a stem 205B forming a single piece with the tab 203B and the base plate 204B. The stem is equipped with two slugs, only one of which is visible in FIG. 3 with reference 206B. The stems 205A and 205B respectively constitute base elements for the supports 208A and 208B.

The tab 203A, the base plate 204A and the stem 205A together form a single-piece support 208A for the rollers 201A and 202A. Likewise, the tab 203B, the base plate 204B and the stem 205B together form a single-piece support 208B for the rollers 201B and 202B.

ZA and ZB respectively denote the longitudinal axes of the stems 205A and 205B.

The slug 206B is secured in rotation with the stem 205B and mounted with the possibility of sliding relative to that stem, parallel to the axis ZB, within an oblong aperture 207B formed in the stem 205B. When the motorized carriage is suspended from the rail, the weight of the casing and/or the curtain drives the slot 206B toward the bottom of the oblong aperture 207B. The same is true for the other slug of the member 200B that is not visible in the figures, which is diametrically opposite the slug 206B relative to the axis ZB.

The slugs 206B and equivalent means are designed to be engaged in grooves 101D formed in the casing 101 and which emerge in the corresponding seats 101E, in the context of a bayonet system.

Two cylindrical housings 109A and 109B are formed in that casing 101 and designed respectively to receive the rods 205A and 205B.

Thus, the mounting of the member 200A on the casing 101 takes place starting from a position where the support 208A is rotated by 90° around the axis ZA relative to the position shown in FIG. 3. The stem 205A is pushed into the housing 109A, following an axial movement relative to the axis ZA shown by arrow F3 in FIG. 3, then the member 200A is rotated around the axis by 90°, in the direction of arrow F4 in FIG. 3. The mounting of the member 200B on the casing 101 takes place in the same way by inserting its support 208B into the housing 109B along a translation of axis ZB, then by rotating that support by 90° around that axis, in the same direction as arrow F4, with the slugs 206B and equivalent means that slide in the grooves 101D and equivalent means.

As shown more particularly in FIG. 4, a spring 301A is housed at the bottom of the housing 109A and by default exerts an upward force F5A on the stem 205A, blocking the slugs 206A and equivalent members in their corresponding seat 101C.

Likewise, a spring 301B is mounted at the bottom of the housing 109B and exerts a force F5B on the stem 205B that pushes the slugs 206B and equivalent means of the corresponding seat 101E.

When the slugs 206A, 206B and equivalent means are pushed back by the springs 301A and 301B toward and in the corresponding seats 101C and 101E, the supports 208A and 208B are immobilized in rotation around the axes ZA and ZB, respectively. The geometry of the slugs, the grooves and the seats can be chosen such that, in this blocked rotation configuration, the axes X200A and X200B are perpendicular to a front-to-back axis A-A' of the carriage 100. Thus, the rollers 201A, 202A, 201B and 202B are parallel to that front-to-back axis, which limits the risks of blocking of the carriage 100 along the rail 50, including after many back-and-forth movements and/or movements in turning areas.

As shown in FIG. 4, the slug 206B is subject to the action of a secondary spring 302 that pushes it in the same direction as the spring 301B and that is housed inside the stem 205B, while being gripped by a headless screw 303B. The tightening of the screw 303B in the stem 205B makes it possible to adjust the intensity of the elastic force F6 exerted by the spring 302 on the slugs 206B and equivalent means. In fact, this force opposes the weight of the casing and/or the curtain on the slug 206B.

It is thus possible, by adjusting the position of the screw 303B in the stem 205B, to adjust the position of the slugs 206B and equivalent means, therefore the height of the rollers 201B and 202B, therefore the intensity of the force pressing the friction wheel 104 against the rolling surface 56, 57 of the rail 50.

For simplicity reasons, only the slugs 206B and equivalent means of the suspension member 200B are associated with means for adjusting their height. Alternatively, the slugs of the two suspension members are adjustable.

Since the housings 109A and 109B are arranged in the casing 101, the rollers 201A, 202A, 201B and 202B are positioned, along the rail 50, at a relatively small distance from the contact zone between the wheel 104 and the surfaces 56 and 57. It is thus possible to provide that the distances between the axes X200A and X104 or between the axes X200B and X104, measured parallel to the axis A-A', when the axes X200A, X200B and X104 are parallel, are smaller than 2 times the diameter of the wheel 104, preferably 1.5 times the diameter. Thus, the support elements 200A and 200B are in the immediate vicinity of the wheel 104, which allows more precise calibration of the friction force between that wheel and the rail and makes it possible to impart good compactness to the carriage 100 in the front-to-back direction. This facilitates the passage over any curved areas of the rail 50 by the carriage 100.

When the members 200A and 200B need to be disassembled relative to the casing 101, it suffices to remove the slugs 206A, 206B and equivalent members from the seats 101C and 101E, against the forces F5A and F5B, to rotate those members around the axes ZA and ZB in the direction opposite that of arrow F4, then to extract the stems 205A and 205B from the housings 109A and 109B, by upward translation along the axes ZA and ZB.

This makes it possible to adapt the dimensions of the part of the suspension members that protrude from the casing 101 relative to the geometry of the rail 50.

For example, as shown in FIG. 3, a moving assembly E according to the invention may comprise not only the members 200A and 200B, which belonged to a first set J1 of suspension members, but also two other members 200A' and 200B', which belong to a second set J2 of suspension members and for which the heights HA' and HB' defined as the heights HA and HB of the members 200A and 200B are greater than the heights HA and HB. In other words, the lower edges of the rollers 201A', 202A', 201B' and 202B' are further from the casing 101 when the members 200A' and 200B' are mounted on that casing than in the case where it is the members 200A and 200B that are mounted there. This is on the one hand due to the fact that the diameters ϕA' and ϕB' of the rollers 201A', 202A', 201B' and 202B' have values smaller than those of the diameters ϕA and ϕB of the rollers of the members 200A and 200B. This is on the other hand due to the fact that the centers CA' and CB' and the axes of rotation X200A' and X200B' of the rollers of the members 200A' and 200B' of the set J2 are higher relative to the surface 101A than in the case of the members 200A and 200B of the set J1. In other words, a vertical distance DA' or DB', defined between the axes X104 and the centers CA' and CB' or the axes X200A' or X200B' of the members of the set J2, has a value greater than that of the distance DA or DB defined with the members of the set J1.

Thus, the members 200A' and 200B' make it possible to cause the carriage 100 to roll on a rail 50 whereof the wings 54 and 55 have thicknesses e54 and e55 greater than those of the rail shown in FIG. 2.

According to one alternative approach, the variation between the height differences ΔA and ΔB of the suspension members of sets J1 and J2 is obtained by acting only on the diameter ϕA, ϕB, ϕA' and ϕB' of the rollers or only on the value of the vertical distance DA, DA', DB or DB'.

It is also or alternatively possible to provide that the modification of the suspension members aims to offset a different deviation between the rolling tracks 51 and 52 from one rail to another, by a different separation between the two rollers of a suspension member.

Thus, the use of different sets J1 and J2 of suspension members, such as the members 200A, 200B, 200A' and 200B', makes it possible to adapt the carriage 100 to the geometry of the rail 50 along which it must move.

The suspension assembly shown in FIG. 3 can comprise more than two sets of two members 200A, 200B, 200A', 200B', based on the geometry and/or the type of different rails with which the carriage 100 can collaborate.

In the second and third embodiments of the invention shown in FIG. 5 and following, the elements similar to those of the first embodiment bear the same references. Unless otherwise stated, the elements of these second and third embodiments are similar to those of the first embodiment bearing the same references and working in the same way.

The carriage 100 of the second embodiment comprises a casing 101 made from plastic in which means are housed for driving a friction wheel 104, those driving means comprising, inter alia, an electric motor (not shown). The friction wheel 104 is designed to roll on two rolling surfaces 56 and 57 formed by the lower surfaces of two wings 54 and 55 of a rail 50. The upper surfaces 51 and 52 of the wings 54 define, on either side of a longitudinal slot 53 of the rail 50, two rolling tracks for rollers 201A, 202A, 201B and 202B belonging to two suspension members 200A and 200B.

These suspension members each comprise a support or hub 212 and a base element 210 fastened on the casing 101, the support or hub 212 being able to be fastened by screwing on the base element 210. Each base element 210 is partially inserted into a housing formed to that end in the casing 101. Only one of these housings is shown in FIG. 5, with reference 109B. The other housing is positioned on the opposite side of the casing 101 and has the same geometry. Each base element 210 is provided with a piercing (not shown) that is passed through by a screw 211 that extends along an axis X211 parallel to the axis X104.

Depending on the degree of tightening of the screws 211 in the corresponding tappings of the casing 101, the base elements 210 may or may not pivot around axes X211, which can make it possible to use the technical teaching of WO-A-2012/004530.

The support or hub 212 of a suspension member 200A or 200B is mounted removably on the casing 201 by screwing that support or hub 212 on a threaded stem 216 that belongs to the corresponding base element 210. In other words, the support or hub 212 is provided with a tapping for receiving the stem 216 of the associated base element 210, which allows a removable mounting of the hubs 212 on the base elements 210, subject to rotation around an axis ZA or ZB, these axes respectively being a longitudinal axis of the base element 210 and of the threaded stem 216 of the suspension member 200A and a longitudinal axis of the base element 210 and the threaded stem 216 of the suspension member 200B. The movement tightening the support to the hub 212 of the suspension member 200A on the corresponding base element 210 is shown by arrow F4 in FIG. 5. A movement in the same direction is used for the suspension member 200B.

As in the first embodiment, X200A and X200B respectively denote the axis of rotation of the rollers of the suspension members 200A and 200B, and CA and CB respectively denote the centers of the rollers 201A and 201B. Likewise, X104 denotes the axis of rotation of the friction wheel 104. As in the first embodiment, DA denotes a vertical distance between the axes X200A and X104, or between the center CA and the axis X104, and DB denotes the vertical distance between the axes X200B and X104, or between the center CB and the axis X104. It is possible to vary the distances DA and DB by screwing the hubs 212 more or less on the base elements 210. Once the value of the distances DA and DB is set owing to the screwing of the hubs 212, it is possible to immobilize those hubs in rotation relative to the axes ZA and ZB, using headless blocking screws 213.

Thus, the blocking screws 213 constitute members blocking the hubs 212 in rotation around the axes ZA and ZB, which makes it possible to give the rollers 201A, 202A, 201B and 202B a predefined orientation relative to a front-to-back axis A-A' of the carriage 100.

According to one approach comparable to that explained for the first embodiment, supports 212 with a different geometry and/or bearing rollers with different dimensions can be mounted on the base elements 210, which makes it possible to adjust the carriage 100 to the actual dimensions of the rail 50 along which it must travel.

In this embodiment, a cradle 150 is provided to be mounted on the casing 101 while having skates 155 and 156 engaged in the inner volume of V50 of the rail 50. This cradle includes two tabs 151 and 152 for attaching the upper part of the curtain, equivalent to the tabs 107 and 108 of the first embodiment.

To allow the cradle 150 to be mounted on the casing 101, an upper web 153 of the cradle 150 is pierced with three openings 1531, 1532 and 1533 respectively allowing the passage of the front suspension member 200A, the friction wheel 104 and the rear suspension member 156. This design of the cradle is also compatible with the first embodiment, the suspension members being fastened by a bayonet system.

The invention has been shown in the case where each suspension member 200A, 200B, 200A', 200B', etc. comprises two rollers. Alternatively, these members may comprise only one roller that rolls on a single track of the rail 50.

Alternatively, the suspension members may be equipped with skates sliding on the tracks 51 and 52. In that case, the distance DA or DB is defined relative to a landmark of the skate, such as its geometric center. The skates may for example assume the form of the skates 155 and 156 of the second embodiment.

FIG. 6 illustrates a system for motorizing a curtain 10 within an installation 1 for screening a window (not shown). The curtain 10, which forms a covering screen, is suspended from a rod 50' that has a solid circular section and that is rectilinear in the example of figures. Alternatively, the rod may be curved, in particular follow a curved wall in which the opening to be screened is formed. Any other rod section shape may be considered, in particular polygonal or oval.

The curtain 10 is provided with several rings or eyelets 12, the inner diameter of which is larger than the diameter of the rod 50', which makes it possible to mount the curtain 10 on the rod 50' by successively inserting the rod 50' in the rings 12. A curtain panel 10 is then defined between each pair of two adjacent rings 12. FIG. 6 shows a front end of the curtain 10. The rear end of the curtain, which is not shown in this figure, is secured to a stop that is stationary relative to the rod 50'. The curtain is closed by moving the curtain to the right in FIG. 6, in the direction of arrow F'1. It is opened by moving it to the left, in the direction of arrow F'2.

The panels of the curtain 10 visible in FIG. 1 and alternatingly offset on either side of the rod are respectively denoted P11, P12, P13, P14 and P15.

At the front panel P11, the curtain 10 is secured to a motorized head carriage 100 that comprises a plastic casing 101 inside which a friction wheel 104 is partially housed. The latter protrudes from the casing 101 through an opening 105 formed in the upper part of that casing. As shown only in FIG. 2, in dotted lines, the casing contains an electric motor 102 and a reducing gear 103 that make it possible to rotate the wheel 104 around a horizontal axis X104 in the usage configuration of the carriage 10. The motor 102 is supplied with electric current from cells or batteries housed in the casing 110 and controlled by an electronic board also housed in that casing, said batteries and said board not being shown for clarity of the drawing.

A-A' denotes an axis defining a front-to-back direction of the carriage 100, i.e., a direction parallel to arrows F'1 and F'2 in FIG. 6, and along which the carriage 100 moves when the wheel 104 rotates. In the normal usage configuration, the axis X104 and the direction A-A' are horizontal. They are still perpendicular to each other.

The casing 110 is equipped with a front suspension member 120 and a rear suspension member 130 that extend upward from an upper surface 115 of the casing 101. The members 120 and 130 are identical and are described below alternatively.

The suspension member 120 comprises a base element 121 that is engaged in a housing 109A formed in the casing 101 and mounted in the housing using the screw 122. In practice, the base element 121 is identical to the base element 210 of the second embodiment and the mounting method for mounting the base element 121 in the housing 109A is similar to that used for the base elements 210 in the second embodiment. Alternatively, the elements 121 and 210 may, however, be different.

An annular element 123 is fastened on the base element 121 and defines an opening O123 with sufficient dimensions for the rod 50' to be able to cross through the annular element.

Within the meaning of the present invention, an annular element is an element that forms a loop closed around a central opening, without necessarily being circular or symmetrical of revolution. In particular, the annular element may be made up of straight elements connected to each other to form the closed loop, without one of the two necessarily having a concave or convex shape.

Y123 denotes a central axis of the annular element 120, in particular of its opening O123. Z121 denotes a longitudinal axis of the base element 121. The axes Z121 and Y123 are perpendicular to each other. The base element is mounted on the casing 101 with a possibility of rotation with limited amplitude, in the example less than or equal to 15°, around a longitudinal axis X122 of the screw 122 in a forward direction from the vertical, the rotation being blocked in the other direction of rotation to form a stop.

The rear suspension member 130 is identical to the front suspension member 120 and comprises a base element 131, whereof the longitudinal axis is denoted Z131 and which is mounted on the casing 101 using a screw 132, with a possibility of rotation with a limited amplitude around a longitudinal axis X132 of the screw 132, in a backward direction relative to the vertical. The axes X12, X122 and X132 are parallel.

The rear suspension member 130 also comprises an annular element 133 that is formed by a support 134, two plates 135 and 136, and a roller 137, and whereof the central axis is denoted Y133.

The plate 135 is articulated on the support 134 using a slug 138 engaged in a corresponding housing 1342 of the support 134. The plate 135 can thus pivot relative to the support 134 around a longitudinal axis Y138 of the slug 138. The plate 136 is identical to the plate 135, and is mounted on the support 134 owing to a slug 139 engaged in a corresponding housing 1344 of the support 134 that extends along a longitudinal axis Y139, which constitutes a pivot axis of the plate 136 relative to the support 134.

To allow them to be articulated on the slugs 138 and 139, the plates 135 and 136 are respectively provided with lugs 1352 and 1362 in which orifices 1354 and 1364 are formed for passage of the slugs 138 and 139.

Unlike the lugs 1352 and 1362, each plate 135 and 136 is provided with a piercing 1356, 1366, respectively, for the passage of a screw 140 and a tapped stem 141, which makes it possible to mount the roller 137 between the plates 135 and 136 by screwing the elements 140 and 141 together through the plates and the roller, and leaving the possibility of rotation around a longitudinal axis X140 of the screw 40, that axis being parallel to the axis X112.

Furthermore, the elements 131 and 134 are connected to each other using a screw 142 that extends globally along the longitudinal axis Z131 of the base element 131. When the annular element 133 needs to be mounted on the base element 131, the screw 142 is inserted into a central piercing of the element 134, which it passes all way through, then it is engaged in a tapping of the element 131 centered on the axis Z131. The screw 142 is then set in rotation around the axis Z131, in the direction of arrow F4 in FIG. 7, which results in firmly assembling the elements 131 and 134 relative to one another, at the end of the screwing of the screw 142. Thus, the support 134 is removably mounted on the base element 131 owing to the rotational movement F4 of the screw 142.

It will be understood that the screw 142 may be more or less screwed into the tapping of the base element 131. This allows the adjustment of the micrometric pressurization between the drive wheel 104 and the rod 50', by adjusting the distance between the element 131 and the assembly 133.

In other words, a vertical distance DA can be defined, similarly to the first embodiment, between the axes X140 and X104. By playing on the position of the screw 142, it is possible to adjust the vertical distance DA. A distance of the same nature can be defined and adjusted similarly at the suspension member 120.

The elements 131 and 134 are blocked in rotation, relative to one another around the axis Z131, by a pressure screw 144 engaged in a tapping 143 shown in FIG. 8 between the two shafts 138 and 139.

The pressure screw 144 thus makes it possible to immobilize the support 134 in rotation around the axis Z131, which makes it possible to impose the angular orientation of the axes X140 relative to the direction A-A'. Furthermore, the pressure screw 144 makes it possible to adjust the height of the support 134 relative to the screw 142 by bearing against a collar of the screw 142, shown in FIG. 7, when that screw 142 is in place in the support 134, but not yet tightened.

Since the pivot amplitude of each of the suspension members 120 and 130, relative to the casing 101 and around the axis X122 or X132, is limited to several degrees, the axes Y123, Y133, Y138 and Y139 remain parallel or globally parallel to the direction A-A' and to the longitudinal axis Y50 of the rod 50' when the carriage is mounted on the rod.

Each plate 135 or 136 has a warped shape, with its concave side turned toward the other plate. This allows the plates 135 and 136 to surround the rod 50', on the right and the left, respectively, when the carriage 100 advances, without contact with the rod 50' and while the lateral bulk of the support 134 and of the roller 137 remains relatively small, in practice less than the diameter of the rod 50'.

The member 120 also comprises a support 124, as well as two warped plates 125 and 126, a roller 127 rotating around an axis X140', a screw 142' and a pressure screw not shown in the figures.

The rollers 127 and 137 are each positioned in the upper part of the annular elements 123 and 133, i.e., opposite the casing 110 relative to the axes X123 and X133.

In the mounted configuration of the installation 1, the two rollers 127 and 137 bear on a track or upper zone 56 of the rod 50', which is shown in gray in order to make it easier to identify in FIG. 7 and which allows the rolling of those rollers. In order to facilitate that rolling, the rollers have a concave outer shape adapted to the radius of the rod 50', which allows linear bearing between the rollers 127 137 and the zone 22. When the movement is in progress, the rollers 127 and 137 then rotate around their axes of articulation, X140 and equivalent, in the annular elements 123 and 133, the circulation axes being horizontal and perpendicular to the axis Y50.

Alternatively, the rollers can be stationary and in the form of skates that do not rotate, sliding on the rod. In that case, it is useful to provide that those skates have a slightly spherical shape on their face sliding against the rod, to accept the incline of the suspension members.

When idle, the axes Z121 and Z131 are parallel and vertical, whereas the axes Y123, Y133, Y138 and Y139 are horizontal and parallel to the axis Y50, as shown in FIG. 4.

The carriage 100 also comprises a member 150 for attaching the curtain 50'. This member comprises a flat stem 151 pierced with two oblong apertures 1512 and 1514, the largest dimension of which is parallel to the longitudinal axis Y151 of the stem 151. The member 150 also comprises two hooks 153 and 155 mounted at the two ends of the stem 151. The axis Y151 is parallel or quasi-parallel to the direction A-A'.

The hook 153 allows the attachment of the curtain 20 on the carriage 100, at the ring 12 closest to the front edge 14 of the curtain. The hook 155 allows attachment of the curtain 10 on the carriage 100, at the second ring 12 starting from the edge 14.

Each of the plates 125, 126, 135 and 136 is equipped, on its face opposite the other plate belonging to the same annular element, with a tab for retaining the stem 151. The tabs 1258 and 1358 of the plates 125 and 135 are visible in FIGS. 2 to 5, and they define a volume partially receiving the stem 151, while the screws 1259 and 1359 inserted into tapped orifices of the tabs 1258 and 1358 respectively penetrate the apertures 1512 and 1514. The attachment member 150 is thus mounted both on the two suspension members 120 and 130, with a possibility of movement parallel to the axis Y151 in light of the oblong nature of the apertures 1512 and 1514. The suspension member is also fastened to the curtain, without, however, bearing the weight thereof, inasmuch as the curtain is suspended by its rings from the rod.

The tab 1368 of the plate 136 is visible in FIG. 3. Just two retaining tabs are sufficient to maintain a stem 151 on the two annular elements.

In the event of forward movement of the carriage 101, in the direction of arrow F1, the weight of the driven portion of the curtain varies, because only the stretched part of the curtain, made up of some of the panels P11, P12, etc., is moved along the rod 50'. Under the effect of this variable weight, the rear suspension member 130, which is increasingly braked, gradually tilts around the axis Y123 in the direction of the arrow F3 in FIG. 5, which results in increasing the contact force between the wheel 104 and the lower surface of the rod 50'. The technical teaching of WO-A-2012/004530 is applied here.

Under the effect of this weight, the stem 151 is pulled backward, until the screw 1359 abuts against the front end of the aperture 1514, as shown in FIG. 5. The screw 1299 also slides in the aperture 1512.

Depending on the movement direction of the carriage 100, one or the other of the suspension members 120 and 130 pivots around one of the axes X122 and X132.

The bearing force of the rollers 127 and 137 on the track or upper zone 56 of the rod 50' is essential to ensure contact of sufficient intensity between the wheel 112 and the rod 50', in order to obtain a constant-speed movement of the carriage 100. To adjust the empty bearing force, micrometric means such as the screw 142 are provided to adjust the position of the support 134 relative to the base element 131. Alternatively, other adjusting means more accessible to the installer may be provided, for example an adjusting knob, which may be pre-adjusted for different rod sections, or graduated.

Thus mounted and adjusted, the carriage 100 is suitable for effectively moving, without risk of sliding, the curtain 10 along the rod 20, which has a solid transverse section.

Inasmuch as the elements inside the casing 101 can be used in the context of an installation 1 comprising a rod such as the rod 50' or in the context of an installation comprising a rail, as considered for the first two embodiments or in WO-A-2012/004530, the supports 124 and 134 of the suspension members 120 and 130 are removably mounted on the casing 101. In fact, it remains possible to disassemble the annular elements 123 and 133 relative to the base elements 121 and 131, by loosening the screws 142 and 144. Thus, it is possible for an installer to select a set of suspension members adapted to the geometry of the rod or the rail, i.e., suspension members like those set out in the first two embodiments or suspension members like those set out in the third embodiment.

Furthermore, it is possible to adapt the elements 120 and 130 to the diameter of the rod 50' by changing the annular elements 122 and 123.

During operation of the installation 1 of this third embodiment, the curtain 10 may be installed on the rod 50' by engaging that rod successively in the rings 12.

The carriage can be installed in the same way, by intercalating the annular elements with the two rings of the curtain closest to the edge. Alternatively, if the curtain is already completely mounted, it is possible to place the carriage 100 without touching the mounting of the curtain. One then begins by unscrewing the screw 140 relative to the rod 141 to remove the roller 137 from the annular element 133 and separate the plates 135 and 136 from each other, by pivoting them around the axes Y138 and Y139. A temporary opening is then created in the annular element 133. The same is done regarding the suspension member 120, by creating a temporary opening in the annular element 123.

It is then possible to place the carriage 100 on the rod 50', between the two rings 12 closest to the edge 14, by inserting the rod 50' into the annular elements 123 and 133, through the temporary openings left free by the rollers 127 and 137 and owing to a movement of the rod in a globally radial direction relative to the axes Y123 and Y133. The dimensions of these openings are adapted to the diameter of the rod 50' by the pivoting of the plates 125, 126, 135 and 136 relative to the supports 124 and 134.

When the orifices 1356 and 1366 arrive above the track or zone 56, it is possible to replace the roller 137 and to once again tighten the screw 140 in the tapped stem 141. The same is done for the suspension member 120. It is then possible to allow the rollers 127 and 137 to rest on the track or zone 56 of the rod 50'. The carriage 100 can then roll on the rod 50'.

The curtain 10 is next attached to the carriage 100 owing to the hooks 153 and 155 of the member 150.

The method is therefore fully advantageous in terms of practicality, since it allows mounting of the carriage after mounting of the curtain, which is not possible the case of installations comprising a rail as considered in WO-A-2012/004530.

The invention is shown in FIGS. 6 to 10 in the case where the rings 12 are incorporated into the curtain 10 like eyelets. This configuration makes it possible to best conceal the carriage by the curtain panels, which imparts a significant esthetic advantage. Alternatively, these rings may be provided in the form of tabs that extend above the curtain and that are secured thereto or distinct rings fastened to the curtain by clips.

In the second and third embodiments, the supports 212, 124 and 134 are not positioned inside the housings 109A and 109B, but across from them, i.e., aligned with them along the direction of the axes ZA, ZB, Z121, Z131. Thus, the suspension members 200A, 200B, 120 and 130 of these embodiments are positioned in the immediate vicinity of the friction wheel 104, which is favorable in terms of controlling the friction force and bulk of the carriage 10 in its front-to-back direction, as explained regarding the first embodiment. In particular, when the axes X200A and X200C are parallel to the axis X104 in the second embodiment, the distances between the axes X200A and X104 or between the axes X200B and X104, measured parallel to the axis A-A', are smaller than 2 times the diameter of the wheel 104, preferably 1.5 times the diameter. The same is true for the distance between the axes X140' and X104 or between the axes X140 and 104 in the third embodiment.

It will be noted that the casing 101 of the second and third embodiments is the same, which is favorable in terms of procurement and inventory management.

The technical features of the embodiments and alternatives considered above may be combined with each other to create new embodiments. In particular, the design of the cradle in the second embodiment is compatible with suspension members fastened by a bayonet system, as described in the first embodiment. Likewise, suspension members with annular elements like those of the third embodiment may be attached on the casing of the carriage by a bayonet system as described in the first embodiment.

In particular, the invention is advantageous inasmuch as it allows an assembly/disassembly of the supports of the suspension members:

manually/without tools, without requiring the disassembly of another element of the casing.

The invention claimed is:

1. A motorized carriage for opening/closing a curtain, said carriage being movable along a rail or a rod by a friction wheel driven by an electric motor, said friction wheel being rotationally mounted in a casing that contains the electric motor, said casing being provided with at least two suspension members for suspending the casing from the rail or the rod, each of said at least two suspension members comprising a support and at least one roller rotating around an axis or a skate, wherein the casing is equipped with a housing for partially receiving and reversibly immobilizing each of said at least two suspension members, such that the rollers or the skates of the at least two suspension members are removably mounted on the casing, wherein the support of each of said at least two suspension members is mounted, removably and through a rotational movement around an axis of rotation, in or directly adjacent to the housing, and wherein the carriage further comprises immobilizing means for immobilizing, in rotation around the axis of rotation, the support or a retaining member for the support.

2. The carriage according to claim 1, wherein the support is immobilized in the corresponding housing by a bayonet mechanism.

3. The carriage according to claim 2, wherein, when the support is placed in the corresponding housing, the support is subject to the action of an elastic return means toward a locked position.

4. The carriage according to claim 2, wherein the support bears at least one slug, the housing of the casing comprises at least one groove for receiving the slug during the rotational movement, and the means for immobilizing the rotation of the support comprise a seat in which the groove emerges and elastic load means for loading the slug toward and in the seat.

5. The carriage according to claim 1, wherein each of said at least two suspension members is fastened on a base element mounted in the housing and the support is mounted by screwing itself or a retaining member on the base element.

6. The carriage according to claim 5, wherein the elements immobilizing the rotation of the support comprise a member blocking the screwing/unscrewing of the support or the retaining element relative to the base element.

7. The carriage according to claim 5, wherein the base element is movable in rotation, within the housing, around an axis perpendicular to the axis of rotation of the support or the retaining member during screwing thereof.

8. The carriage according to claim 1, further comprising means for adjusting a vertical distance between an axis of rotation of the roller and an axis of rotation of the friction wheel.

9. The carriage according to claim 8, wherein the support is immobilized in the corresponding housing by a bayonet mechanism and the adjusting means comprise a screw for adjusting the position of at least one slug belonging to the bayonet mechanism relative to the support.

10. The carriage according to claim 8, wherein each of said at least two suspension members is fastened on a base element mounted in the housing, the support is mounted by screwing itself or a retaining member on the base element and the adjusting means are formed by the connecting means screwed between the support and the base element.

11. The carriage according to claim 1, further comprising means for adjusting the contact force between the friction wheel and the rail or the rod.

12. The carriage according to claim 1, wherein a distance, measured parallel to a front-to-back axis of the carriage, between an axis of rotation of the roller and an axis of rotation of the friction wheel is less than 2 times the diameter of the friction wheel.

13. An installation for screening an opening comprising a rail or a rod, a motorized carriage and a curtain attached to that motorized carriage, wherein the carriage is according to claim 1.

14. A motorized carriage for opening/closing a curtain, the carriage being movable along a rod by a friction wheel driven by an electric motor, the friction wheel being rotationally mounted in a casing that contains the electric motor, said casing being provided with at least two suspension members for suspending the casing from the rod, wherein each of said at least two suspension members comprises an annular element that surrounds the rod and which includes a rotating roller that rolls against the rod, and wherein the rotating roller is positioned opposite the casing relative to a central axis of the annular element.

15. The carriage according to claim 14, wherein each said annular element comprises two plates positioned on either side of the rod and between which the roller is rotatably mounted.

16. The carriage according to claim 15, wherein each of said two plates is articulated on a support for the at least two suspension members, around an axis perpendicular to an axis of rotation of the roller and globally parallel to a front-to-back direction of the carriage.

17. The carriage according to claim 15, wherein each of said two plates has a warped shape, with its concave side turned toward the other of said two plates of the respective one of said at least two suspension members.

18. The carriage according to claim 14, further comprising an attaching member for attaching the curtain, the attaching member being mounted on the at least two suspension members.

19. The carriage according to claim 18, wherein the attaching member is movably mounted on at least one of the at least two suspension members.

20. The carriage according to claim 18, wherein the attaching member has an elongated shape, extends globally in a front-to-back direction of the carriage and comprises, at each of its ends, means for attaching the curtain.

* * * * *